United States Patent [19]

Terrell et al.

[11] Patent Number: 4,619,318

[45] Date of Patent: Oct. 28, 1986

[54] CHEMICAL CUTTING METHOD AND APPARATUS

[75] Inventors: Jamie B. Terrell; Donna K. Pratt, both of Fort Worth, Tex.

[73] Assignee: Gearhart Industries, Inc., Fort Worth, Tex.

[21] Appl. No.: 655,877

[22] Filed: Sep. 27, 1984

[51] Int. Cl.[4] ..... E21B 29/02

[52] U.S. Cl. ..... 166/55; 166/212; 166/297

[58] Field of Search ..... 166/55, 55.1, 297, 212, 166/63, 299; 175/4.6

[56] References Cited

U.S. PATENT DOCUMENTS

| | | | |
|---|---|---|---|
| 2,144,208 | 1/1939 | Van Meter | 166/297 |
| 2,918,125 | 12/1959 | Sweetman | 166/297 |
| 3,076,507 | 2/1963 | Sweetman | 166/297 |
| 4,158,389 | 6/1979 | Chammas et al. | 166/297 |
| 4,180,131 | 12/1979 | Chammas | 166/55 |
| 4,345,646 | 8/1982 | Terrell | 166/212 X |
| 4,352,397 | 10/1982 | Christopher | 166/297 |
| 4,415,029 | 11/1983 | Pratt et al. | 166/212 |
| 4,446,920 | 5/1984 | Woytek et al. | 166/297 |
| 4,494,601 | 1/1985 | Pratt et al. | 166/55 |

*Primary Examiner*—Stephen J. Novosad

*Attorney, Agent, or Firm*—Richards, Harris, Medlock & Andrews

[57] ABSTRACT

A downhold chemical cutting process for cutting a target object within a well. A source of a gaseous chemical cutting agent comprising a nitrogen fluoride is introduced into the well adjacent the target object and employed in a cutting operation in which the nitrogen fluoride cutting agent is directed against the target to the cut. A gaseous cutting agent source such as a mixture of florine and nitrogen trifluoride may be employed. Alternatively a perfluoroammonium salt which decomposes upon heating to produce a mixture of florine and nitrogen fluoride may be employed. A cutting tool comprising pressure actuated anchoring means, pressure generating and chemical sections, and a cutting section having a downwardly extending nozzle. The nozzle is provided with a standoff sleeve to provide a desired distance between the target object to be cut within a well bore and the nozzle outlet. A compound piston may be slidably disposed within the chemical section of the tool to prevent comingling between pressurizing fluid developed in the tool and a chemical cutting agent contained within the chemical section.

14 Claims, 8 Drawing Figures

FIG. 4
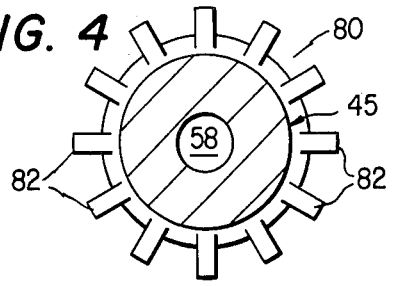
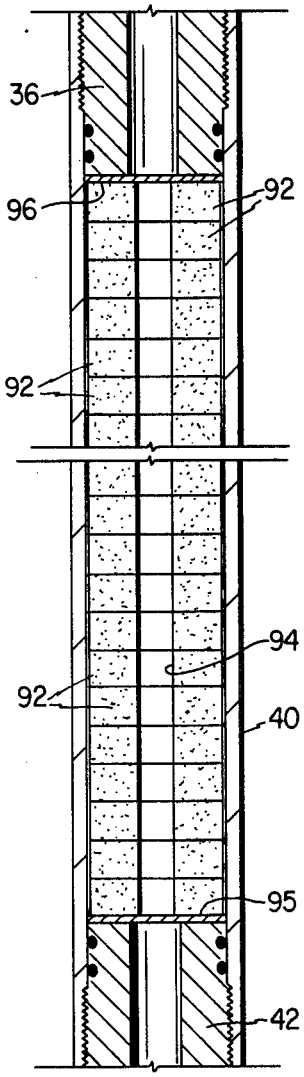
FIG. 5
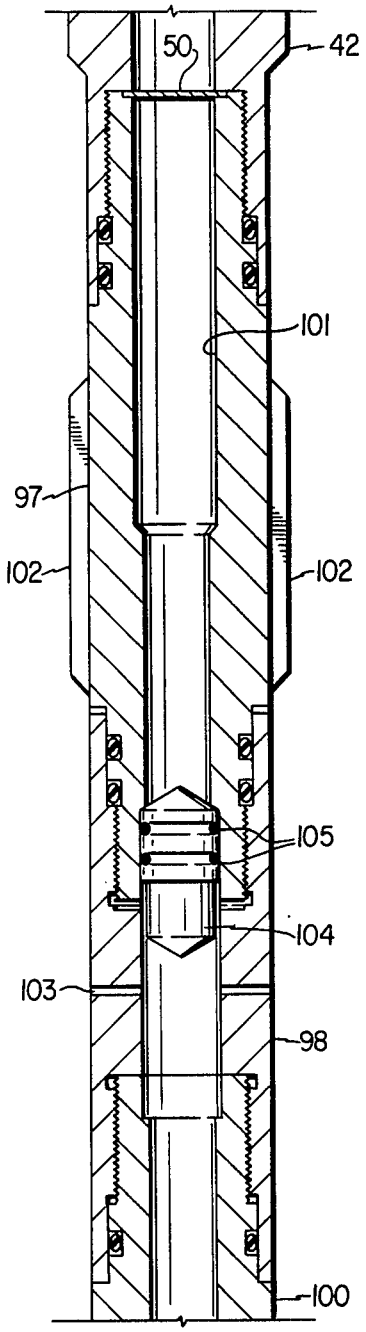
FIG. 6

CHEMICAL CUTTING METHOD AND APPARATUS

TECHNICAL FIELD

This invention relates to downhole well processes and tools and more particularly to chemical cutting processes and tools for the cutting of target objects at downhole locations within a wellbore.

BACKGROUND OF THE INVENTION

There are many circumstances in the oil industry where it is desirable to cut into or through a downhole object within a well. A typical application is in the cutting of downhole tubular goods within a well. For example, in the course of drilling a well, the drill pipe may become stuck at a downhole location. This may result from "keyseating" or as a result of cuttings which settle within the well around the lower portion of the drill string. In order to remove the drill string from the well, it may be necessary to sever the drill pipe at a location above the stuck point. Similarly, it is often necessary to carry out downhole cutting operations during the completion or operation of oil or gas wells. For example, it is sometimes desirable to sever casing or tubing at a downhole location in order to make repairs or to withdraw the tubular goods from a well which is being abandoned. In other circumstances it is desirable to cut slots, grooves or perforations in downhole tubular goods. Thus, it is a common expedient to perforate the casing and surrounding cement sheath of a well in order to provide fluid access to a hydrocarbon bearing formation. Similarly, it is sometimes desirable to perforate tubing in the completion or recompletion of a well.

While mechanical means may be employed to cut downhole objects, this is often accomplished through chemical cutting techniques. Shaped charges may be employed to perforate or sever tubular goods within the well. Another technique involves the application of a chemical cutting agent which cuts through objects in the well by direct chemical reaction. For example U.S. Pat. No. 2,918,125 to Sweetman discloses a downhole chemical cutter which employs cutting fluids that react violently with the object to be cut with the generation of extremely high temperatures sufficient to melt, cut, or burn the object. Examples of cutting agents disclosed in Sweetman are fluorine and the halogen fluorides including such compounds as chlorine trifluoride, chlorine monofluoride, bromine trifluoride, bromine pentafluoride, iodine pentafluoride and iodine heptafluoride. The cutting fluid is expelled from the tool through radial ports in jet cutting streams. The attendant reaction is highly exothermic and the tubing, drill pipe, etc. is rapidly penetrated. In Sweetman, the cutting ports extend radially from a central bore within the discharge head of the cutting tool which terminates in a reduced diameter bore which is open to the lower or front end of the cutting tool. The reduced diameter bore is internally threaded to receive a threaded plug which closes the lower end of the bore.

Various means may be employed to anchor the cutting tool at the desired location within the well. This is particularly important when, as in the case of the Sweetman apparatus, the cutting tool is run into the well on a wire line. Thus, in Sweetman, the cutting tool may be anchored by means of bow-spring mounted slips which, upon relative movement between the slip cage and a frusto-conical mandrel, are displaced outwardly into gripping engagement with the surrounding wall structure. Another technique disclosed in the Sweetman patent and also in U.S. Pat. No. 4,180,131 to Chammas employs fluid pressure from a suitable source to both activate the anchoring means and to dispel the chemical cutting fluid from the tool against the surface to be severed or otherwise cut. For example, in the Chammas patent, a cutting tool is disclosed in which gas from a propellant charge displaces a piston against the action of a compression spring to cam one or more wedges outwardly against the tubing string to be cut. The gas from the propellant charge is also employed to force the chemical cutting fluid, preferably bromine trifluoride, into contact with a preignitor e.g. steel wool, and thence downwardly through the bore of a severing head. The severing head bore is open to the front end of the severing head and contains a pressure transmitting fluid which is retained in place by a diaphragm that is ruptured when the tool is fired. A plurality of radial discharge ports extend from the interior bore of the severing head to the exterior of the tool. A piston is disposed in the bore adjacent these cutting ports. When the tool is fired, the chemical agent under pressure forces the piston downwardly into a reduced section of the cutting head bore where it is held in place. In this position, the piston is below the cutting ports and the chemical cutting fluid is forced outwardly through the ports and against the tubular goods to be cut.

Particularly suitable chemical cutting tools are disclosed in U.S. Pat. Nos. 4,345,646 to Terrell and 4,415,029 to Pratt and Terrell, the inventors herein. In these tools, which employ a halogen fluoride such as bromine trifluoride as the chemical cutting agent, a chemical module assembly is located intermediate a propellant and slip assembly and a discharge head assembly. Gas pressure generated by the ignition of a propellant charge is employed to rapidly move a slip array against a conical mandrel to expand the slip array. During this time the cutting action takes place. The slip array is then rapidly retracted by means of a biasing mechanism such as a compression spring. The gas pressure also forces the chemical cutting agent from the chemical module assembly into the discharge head and passed an ignitor such as steel wool. The discharge head is provided with radial discharge ports which are normally closed by a piston. The chemical cutting agent under the applied gas pressure forces the piston downward, thus opening the ports to the cutting agent. The slip array in the Terrell and Pratt et al patents comprises a plurality of slips which are biased inwardly and which comprise several sets of gripping teeth to accommodate use of the tool in tubular goods of different diameters.

Yet another downhole cutting tool which employs gas-forming and non-gas forming pyrotechnic compositions is disclosed in U.S. Pat. No. 4,352,397 to Christopher. In this tool, an ignitor section is provided near the top of the tool followed by a column of non-gas-forming pyrotechnic fuel composition which extends into a first set of solid annular pellets formed of a gas-forming pyrotechnic fuel composition. At the lower end of the tool is a fuel chamber filled with a plurality of stacked annular pellets formed of a gas-forming pyrotechnic fuel composition. A powdered non-gas forming pyrotechnic fuel composition is disposed within the central passage formed by the stacked pellets. Intermediate the fuel chamber and the ignition assembly is a central portion having a plurality of radially extending cutting ports. The non-gas-forming pyrotechnic fuel composition is a mixture of a metal-metal oxide mixture such as "thermite" and the gas-forming fuel composition is a similar metal-metal oxide mixture which also includes polytetralfluoroethylene (teflon) in an amount within the range of about 1 to 60% by weight. Upon ignition of the pyrotechnic fuel formulation within the fuel chamber, the resulting pressure forces the hot reaction products upwardly through the tool into the discharge ports.

DISCLOSURE OF THE INVENTION

In accordance with the present invention, there are provided new and improved downhole chemical cutting processes and tools. In carrying out the invention, a source of a gaseous chemical cutting agent which includes nitrogen-fluoride is introduced into a well adjacent the target object to be cut. The nitrogen-fluoride containing cutting agent is directed from the source against the target object to provide a penetrating cut therein. Preferably the gaseous cutting agent comprises a mixture of molecular fluorine and nitrogen fluoride. In a further embodiment of the invention, the nitrogen fluoride is nitrogen trifluoride.

In one aspect of the invention, the cutting-agent source comprises a confined pressurized gas which includes a mixture of nitrogen fluoride and molecular fluorine which is maintained under a pressure of at least 400 psi. In another aspect of the invention, the cutting agent source comprises a perfluoroammonium salt which decomposes upon heating to produce a mixture of molecular fluorine and nitrogen fluoride. In a further embodiment, the gaseous cutting agent is produced from the perfluoroammonium salt by igniting a metal-metal oxide mixture in the presence of the perfluoroammonium salt.

In a further aspect of the invention, there is provided a new and improved downhole cutting tool for cutting passageway obstructions within a wellbore. The cutting tool comprises an elongated tool body adapted for insertion into the wellbore and anchoring means associated therewith which function to anchor the tool during the cutting operation. The tool further comprises a chemical section adapted to contain a chemical cutting agent source and a cutting section in the front of the tool and in fluid communication with the chemical section. A pressure generating section within the tool includes means for providing actuating pressure to displace the cutting agent from the chemical section into the cutting section. The front of the cutting tool is provided with a downwardly extending nozzle which extends from the interior to the exterior of the tool body. A standoff sleeve, having a diameter which is reduced with respect to the outer diameter of the tool body extends downwardly from the front of the tool to provide a standoff distance between the cutting port and the object to be cut.

BRIEF DESCRIPTION OF THE DRAWINGS

FIG. 4 is a cross sectional view taken along line 4—4 of FIG. 2B;

FIG. 5 is a side elevation in section of the chemical assembly of a cutting tool formed in accordance with a modification of the invention, and FIG. 6 is a side elevation in section of yet another modification of the present invention.

BEST MODES FOR CARRYING OUT THE INVENTION

The present invention provides improved downhole chemical cutting tools of the type useful in cutting through wellbore obstructions. The invention further provides improved downhole cutting processes employing nitrogen fluoride cutting agents which may be employed in such tools or in downhole cutting tools of the type employed in cutting tubular goods such as disclosed in the aforementioned patents to Terrell and Pratt et al. The invention will initially be described with reference to downhole shooting tools of the type used in clearing obstructions within a wellbore.

Figure 1:
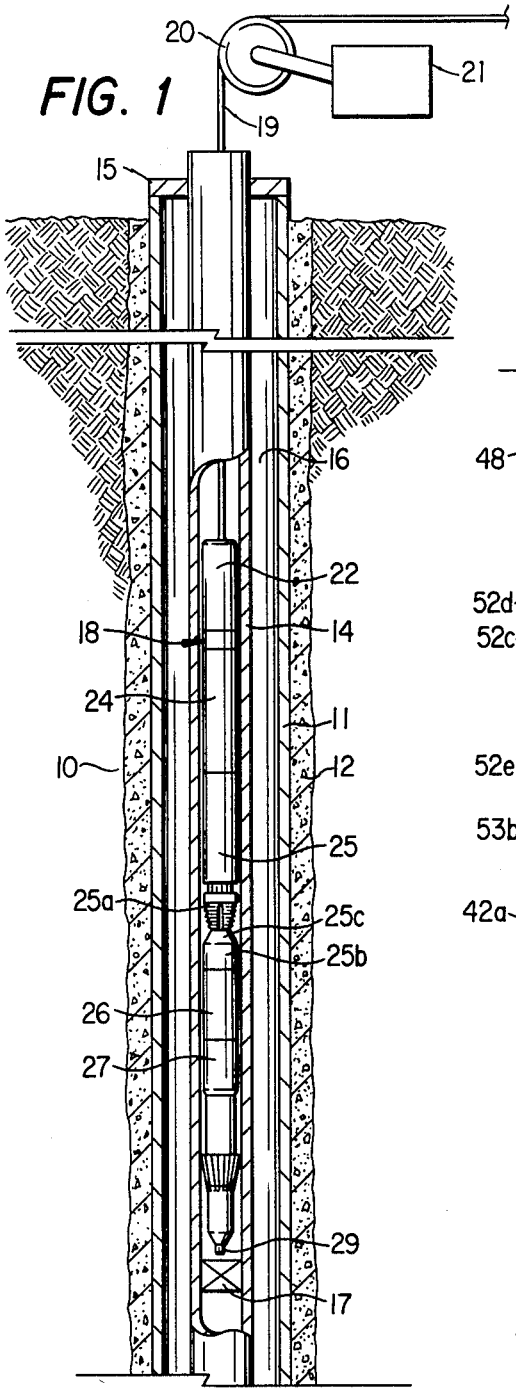
FIG. 1 is an illustration, partly in section, showing a downhole chemical cutting tool located in a well at a position to cut an obstructing target object.

Turning first to FIG. 1 of the drawings, there is illustrated a chemical cutting tool formed in accordance with one embodiment of the invention. The tool is located within a well extending from the surface of the earth to a suitable subterranean location e.g. an oil and/or gas producing formation (not shown). More particularly and as illustrated in FIG. 1, a wellbore 10 is provided with a casing string 11 which is cemented in place by means of a cement sheath 12. A production tubing string 14 in the well extends from the wellhead to a suitable downhole location (not shown). The tubing string and/or the annular space 16 between the tubing and the casing may be filled with high pressure gas and/or a liquid such as oil or water. Alternatively, the tubing string or the well annulus may be "empty" i.e. substantially at atmospheric pressure. By way of an example illustrating the practice of the present invention, the tubing string has an undesired obstruction 17 which prevents the flow of fluid or the passage of well tools through the tubing string. For example, the obstruction 17 may take form of an in-line ball valve which is stuck in the closed position and cannot be opened by the normal techniques.

As further illustrated in FIG. 1, there is shown a chemical cutting tool 18 which has been lowered through the tubing string to a desired location immediately above the obstruction 17 which is the target object of the cutting tool. The cutting tool is suspended from a wire line cable 19 which passes over suitable indicating means such as a measuring sheave 20 to a support and pulley system (not shown). The measuring sheave 20 produces a depth signal which is applied to an indicator 21 to give a readout of the depth at which the tool is located.

The chemical cutter 18 is composed of five sections. At the upper end of the tool there is provided a fuse assembly 22 comprised of a firing adaptor, firing sub and an electrically activated fuse. Immediately below the fuse assembly 22 is a propellant section 24 which provides a source of high pressure gas. For example the propellant section may take the form of a chamber containing pellets of a propellant such as gun powder which burns to produce the propellant gases. Immediately below the propellant section 24 is a section 25 comprising means for anchoring the tool body in the tubing string. The anchoring means takes the form of a slip array 25*a* comprising a plurality of slip segments. The slip array is slidably disposed on a central shaft to which a slip expander 25*b* having a tapered surface 25*c* is secured. The slip array is moved downwardly by means of an actuator having a piston-cylinder type configuration. The activator and the connected slip array move downwardly against suitable biasing means such as a compression spring.

A chemical module section 26 is located below the slip assembly. This section contains a source of a gaseous chemical cutting agent as described in detail hereinafter. Immediately below the chemical section is a cutting assembly 27. This section contains an ignitor material which functions to preactivate the cutting agent before it is impacted upon the target object. The ignitor material may take the form of an "ignitor hair" such as steel wool. The bottom of the cutting head is provided with a downwardly extending nozzle passage which extends from the interior of the tool to the exterior thereof to direct the cutting fluid in a downward direction against the target object 17. As will be described in greater detail hereinafter, the cutting passage is provided with a blowout plug (shown in FIG. 3) and a downwardly projecting sleeve 29 which provides a standoff distance between the cutting port and the target object.

The operation of the chemical cutting tool may be described briefly as follows. The tool is run into the well on the wire line 19 until the bottom of the tool encounters the target object obstruction 17. The tool is allowed to rest upon the target object with the sleeve 29 providing the desired standoff distance between the surface of the obstruction and the cutting port outlet.

An electrical signal is then sent via wire line 19 to the cutter tool where it sets off the fuse, in turn igniting the power pellets. As these pellets burn, a high pressure gas is generated and travels downwardly through a passageway in the central shaft of the slip section. The resulting application of pressure against the slip assembly actuator forces the slip array downwardly over surface 25*c* to move the slip segments outwardly to the deployed position where they grip the inner surface of the tubing. The slip array thus anchors the cutter in the tubing against upward movement. As the gas pressure further increases, shear diaphragms within the chemical module are ruptured and the gaseous cutting agent, either as originally contained within the tool or as generated in situ as described hereinafter is forced through the ignitor hair which pre-ignites the chemical. The gas pressure then forces the activated chemical into the cutting section and ultimately outwardly through the downward directed cutting port. In a short period of time, normally less than a second, the tubing is severed and the slip array is retracted as the fluid pressure in the tool is released and allows the slip array to move upwardly under the action of the biasing means. The tool can then be withdrawn from the borehole.

The fuse assembly, the propellant section, and the anchor section, including the slip array and the operating mechanism therefore, may be of any suitable type such as disclosed in the aforementioned U.S. Pat. Nos. 4,345,646 to Terrell and 4,415,029 to Pratt et al. For a further description of these mechanisms and the general operating conditions and parameters patents, the disclosures of which are incorporated herein by reference.

Figure 2C:
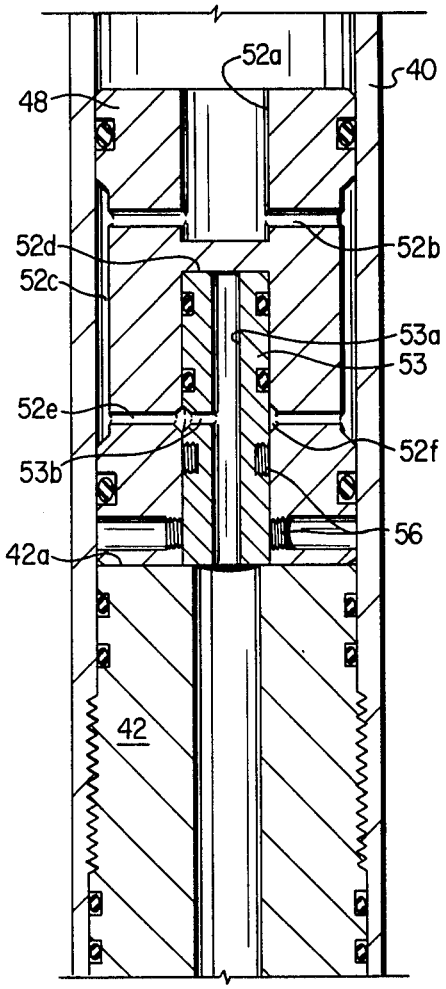
FIG. 2C is a side elevation in section of an intermediate portion of the cutting tool at the conclusion of a cycle of operation.
Figure 2A:
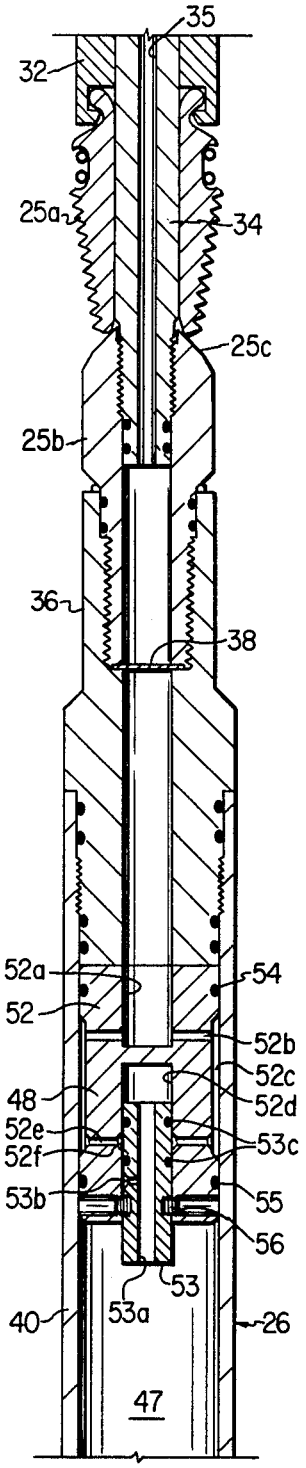
FIGS. 2A and 2B are longitudinal side elevational views in section of intermediate and lower portions, respectively, of the cutting tool illustrated in FIG. 1.
Figure 2B:
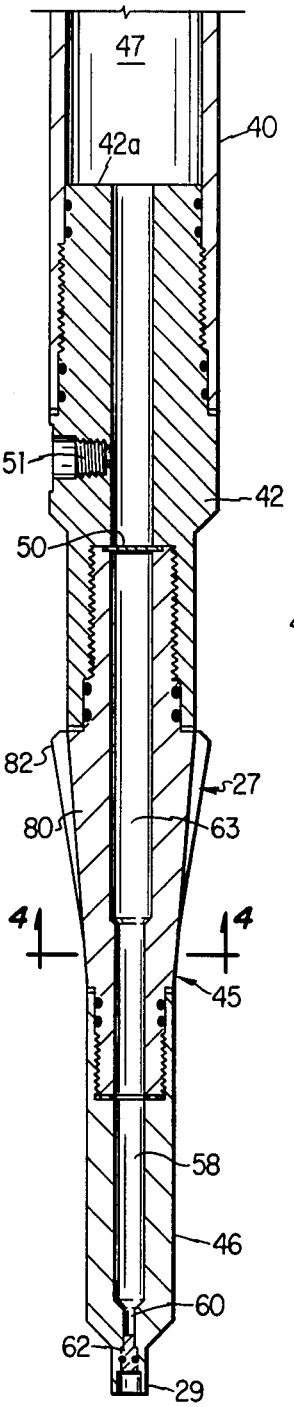

FIGS. 2A and 2B are longitudinal sectional views illustrating a portion of the anchoring section, the chemical section, and the cutting head section of the tool 18. As shown in FIG. 2A, the slip array 25*a* comprises a plurality of slips which are secured to the front portion 32 of a slip piston. When the slip piston is moved forward upon firing of the propellant charge (not shown), the slip array is moved forward over a slip shaft 34 against the surface 25*c* of the slip expander 25*b*. The slip shaft 34 has a longitudinal passage 35 which provides for fluid communication between the propellant section 24 (FIG. 1) and the interior of the chemical section 26. The slip expander 25*b* is connected to the chemical section by means of an adapter sub 36 fitted with a frangible seal diaphragm 38. The chemical section comprises a container tube 40 which is threadedly secured to sub 36 and a loading body 42 as shown in FIG. 2B. Loading body 42 is in turn secured to cutting assembly 27 which comprises an ignitor sub 45 and a head sub 46.

In the embodiment illustrated, the chemical section comprises a high-pressure gas chamber 47 closed at one end by a slidable compound piston 48 (FIG. 2*a*) and at the other end by a frangible seal diaphragm 50 (FIG. 2*b*) secured in place at the threaded connection between loading body 42 and ignitor sub 45. A high pressure gaseous cutting agent is contained in chamber 47 under an elevated pressure. The gaseous cutting agent is loaded into the chemical chamber by means of a loading port assembly 51 in the body 42.

The cutting section 27 is comprised of the head sub 46 and ignitor sub 45 and has a central bore 58 which is provided with a downwardly directed cutting nozzle 60. A blowout plug 62 seals the cutting nozzle. The central bore within the tool is enlarged as indicated by reference numeral 63 to provide a chamber in which the ignitor material (not shown) is contained. The threaded connections are provided with suitable packing means such as the o-rings shown in the drawings.

In operation of the tool illustrated in FIGS. 2A and 2B, upon ignition of the propellant and generation of pressure within the tool, the slip array 25*a* is expanded to anchor the tool and diaphragm 38 is ruptured. As the piston 48 is driven forward, the resulting increase in pressure ruptures diaphragm 50 and forces the cutting agent into contact with the ignitor material within enlarged bore section 63. The preactivated cutting agent is then discharged from the nozzle 60 into contact with the target object. Piston 48 functions to prevent any significant mixing between the propellant gases and the gaseous cutting agent.

The piston 48 drives the cutting gas from the tool and then functions to open the pressure generating section to fluid communication with the exterior of the tool, thus venting the propellant gases at the end of the cycle of operation. This latter function is accomplished by virture of the compound structure of the piston which comprises a main body portion 52 having a passageway system for providing fluid communication between the front and back of the piston, and a valve plug 53 which in the normal position shown, in FIG. 2A, closes the passageway system. The passageway through the main body portion 52 of the piston comprises a central bore 52*a* and radial ports 52*b* extending from the central bore to a chamber 52*c* formed by a reduced intermediate section of the piston member 52. Chamber 52*c* is sealed by means of o-rings 54 and 55 in the enlarged end sections of the piston. Valve member 53 is slidably disposed within a second central bore 52*d* within the main body portion and is held in place by means of shear screws 56. Valve plug 53 is provided with a central passageway 53*a* and a radially extending port 53*b* terminating in a circumferential groove in the outer wall of member 53. Ports 52*e* extend radially inward from the recessed portion of piston member 52 and terminate in a circumferential recess 52*f* in the wall of bore 52*d*. O-rings 53*c* in the plug valve member 53 close the ports 52*e* to a fluid flow when the plug member is in the position shown.

When the piston 48 is driven to its forward position, the leading edge of plug 53 strikes the upper face 42*a* of sub 42, thus shearing the shear screws 56 and driving the plug upwardly so that it is displaced to the position shown in FIG. 2C. As shown in FIG. 2C, the groove and the port 53*b* in plug 53 is aligned with the ports 52*e* and the recess 52*f* in bore 52*d*. The back end of the plug abuts against the end of bore 52*d* to prevent the plug from being driven past the aligning position. With the plug member in the position shown, propellant gases are allowed to vent from the pressure generating section through bore 52*a*, ports 52*b*, chamber 52*c*, ports 52*e* and 53*b*, chamber 53*a* and thence downwardly through the tool where they flow out of the cutting port. This releases pressure within the tool, thus allowing retraction of the slip array.

Figure 3:
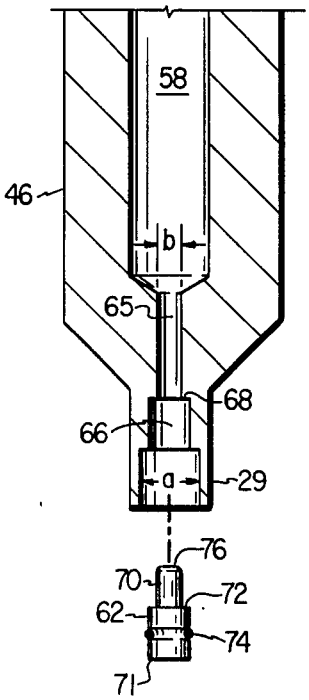
FIG. 3 is an enlarged side elevational view, partly in section, showing details of the front cutting portion of the tool segment illustrated in FIG. 2B.

FIG. 3 is an enlarged side elevation of the nose of the cutting tool and illustrates details of the cutting nozzle, standoff sleeve, and blowout plug (shown in an exploded perspective). As shown in FIG. 3, the downwardly directed passage from the interior of the tool is compounded, comprising a reduced bore section 65 and a front bore section 66 which is slightly enlarged to provide a shoulder 68. The blowout plug 62 has reduced and enlarged sections 70 and 71 which correspond to bore sections 65 and 66, respectively in an interference relationship (frictional fit) so that the plug remains in place when the tool is run in the well. The shoulder annular 72 of the plug abuts the shoulder 68 within the compound bore. The enlarged plug section is provided with a suitable sealing means such as an o-ring 74. From an examination of FIG. 3, it will be recognized that upon application of the high pressure surge within the interior of the tool, the blowout plug will be readily propelled from the tool ahead of the cutting fluid. On the other hand, the relatively large cylindrical surface area of section 71 (in frictional engagement with bore 66) and the relatively small surface area of face 76 will prevent accidental ejection of the plug. In addition, if high pressure environments are encountered in the well, the shoulder-abutment relationship between the plug and the compound cutting passage prevents the plug from being forced upwardly into the tool. This latter occurrence could result in premature ejection of cutting fluid from the tool.

The standoff sleeve 29 performs several important functions. The sleeve allows the tool to be lowered to a point where it actually rests on top of the target object so that the standoff distance between the cutting port and the target object is clearly defined. The sleeve is reduced substantially with respect to the outer bore diameter of the tool so that other obstructions or narrowing occlusions within the tubing bore (or other well passage) will not prevent the tool from being lowered to the point where the cutting port is spaced from the target object by the desired distance. Also, the sleeve configuration, in which the internal diameter of the sleeve as indicated by dimension a is substantially greater than the diameter of bore 65, dimension b, provides substantially better cutting penetration than other standoff configurations tested.

The embodiment illustrated in FIG. 3, in which only a single downwardly directed nozzle is employed, is the normal configuration of the invention. However, a plurality of such downwardly directed nozzles may be employed, particularly where it is desired to cut through an obstruction in a casing or an unusually large tubing string. In this case, a somewhat larger diameter cutting tool may be employed having two or more downwardly directed cutting nozzles. For example, three nozzles spaced equally in a triangular configuration may be employed. Alternatively, a central nozzle, having a plurality of surrounding nozzles may also be employed. In this case, the surrounding nozzles may shoot straight downwardly or, while being downwardly directed, may diverge somewhat from the vertical.

In accordance with a further aspect of the invention, an ablative shield structure is provided near the front of the cutting tool. This structure materially prolongs the life of the tool. As shown in FIG. 2B and FIG. 4, the ablative structure comprises a rearwardly divergent outer tool surface indicated by reference no. 80 and a plurality of longitudinally extending ribs 82 which are disposed peripherally about the outer surface of the tool body. Preferably, the ribs also taper in a rearwardly divergent manner as best shown in FIG. 2B. The taper of the ribs is greater than the taper of the tool surface, so that the ribs become progressively thicker toward the rear of the tool.

The tapered configuration illustrated tends to direct the hot gases resulting from the cutting operation outward as they travel upwardly around the tool. In addition, the ribs provide a sacrificial ablative function so that heat deterioration occurs in the rib section rather than in the remainder of the tool. Since the portion of the tool with the ablative shield normally will have a much shorter useful life than the remainder of the tool, it is incorporated into a sub, in this case the ignitor sub, which can be readily removed from the rest of the tool. The ablative ribs may be formed integrally with the ignitor sub or they may be formed of a different material than the sub and secured thereto by any suitable means.

The well tool illustrated in 2A and 2B is employed where the cutting agent source is a nitrogen fluoride containing gas confined under pressure within the tool. With minor modifications, the tool can be adapted to the embodiment in which a nitrogen fluoride containing gas is derived by heating of a solid source, specifically a perfluoroammonium salt, which decomposes upon heating to produce nitrogen flouride. This embodiment of the invention is illustrated in FIG. 5 which is a side elevational view of the chemical section of the tool modified to accept a solid source of gaseous cutting agent.

As shown in FIG. 5, this embodiment of the invention is similar to that shown in FIGS. 2A and 2B with the exception that the compound piston and gas charge are replaced with the solid gas source and heating composition. The hot propellant gases generated upon firing of the tool are employed to ignite the heating composition which typically will be an ignitable metal-metal oxide mixture such as thermite. The metal-metal or thermite type component produces heat for the chemical decomposition of the solid source substance, e.g. a perflouroammonium salt as described in greater detail hereinafter.

In the preferred embodiment illustrated, the source substance is comprised of a plurality of annular rings 92 which are stacked with respect to one another to provide a central passageway 94 within which the heat generating substance is disposed. In this case, the source material, the heat generating material, and the tool may be transported to the well site separately and the tool loaded immediately prior to insertion into the wellbore. This mode of operation is particularly advantageous since the perfluoroammonium salts are relatively stable, and thus may be transported without serious hazard. The annular pellets are loaded into the chemical section chamber formed by sleeve 40 which is closed at its ends by plates 95 and 96 which are capable of supporting the weight of the source and heating materials but are readily ruptured upon firing of the tool by the heat and/or pressure generated. After the annular pellets are loaded to provide the interior passageway 94 as shown, the metal-metal oxide heat generating material is poured into the central section, the closure plate 96 put in portion and the sub 36 threaded into the tube 40 so that they are connected as shown in FIG. 5.

As noted above, the embodiment illustrated in which the metal-metal oxide mixture is formed in a discrete body located in proximity to the perfluoroammonium salt is preferred from standpoint of safety and handling. However, instead of forming the nitrogen fluoride producing substance in solid annular pellets as illustrated, it may be in granular form admixed with the metal-metal oxide heat generating material. Yet, another embodiment involves the use solid annular pellets of a perfluoroammonium salt which include a metal-metal oxide mixture disbursed therein. In addition, a central column of the metal-metal oxide mixture extends within a central passageway as shown.

In operation of the embodiment illustrated in FIG. 5, the tool is lowered in the hole to the desired location adjacent the target object as described previously. When the electrical firing signal is applied via line 19 to the chemical cutting tool, the ignitor squib is fired in the fuse assembly 22 and the resulting hot propellant gases ignite the thermite type charge.

As a result of the applied heat, the perfluoroammonium salt is decomposed to produce the gaseous nitrogen fluoride containing cutting agent and the propellant in the propellant section is ignited to produce the propellant gases, thus generating pressure and anchoring the tool as described previously. The gaseous cutting agent is expelled past through the ignitor section where it is activated and then through the bottom cutting port to cut the target object.

Another embodiment of the present invention comprises a chemical cutting tool that is adapted to cut tubular target objects as disclosed in the aforementioned U.S. Pat. Nos. 4,345,646 and 4,415,029. In this embodiment, illustrated in FIG. 6, the cutting assembly contains one or more radially extending cutting ports through which the fluid is directed against the interior wall of the well tubing or other tubular object to be cut within the well. Normally, the cutting section will be equipped with a plurality of ports extending about the periphery of the tool in order to completely sever the tubular object as described in the aforementioned U.S. Pat. Nos. 4,345,646 and 4,415,029.

As shown in FIG. 6, the cutting section in this embodiment of the invention comprises an ignitor sub 97 and a cutting assembly which includes a cutting-head 98 and a nose sub 100 which forms the front end of the tool. The ignitor sub 97 is connected to sub 42 by a threaded connection within which a rupturable diaphragm 50 is inserted as described previously. The sub 42 is in turn connected to the remainder of the tool (not shown), which may be constructed to employ either a gaseous cutting agent source as in the embodiment of FIGS. 2A and 2B, or a solid cutting agent source as in the embodiment of FIG. 5. The ignitor sub contains an enlarged bore section 101 which is adapted to contain an ignitor material (not shown) suitable for activation of the cutting fluid as described previously. In the side cutting embodiment, ablative ribs of the type described previously may also be provided in the cutting section of the tool adjacent the cutting ports. Thus, the ignitor sub is formed of a tubular member having a reduced diameter relative to sub 42 and provided with a plurality of longitudinally extending ablative ribs 102. Although not shown in FIG. 6, the ablative system may be tapered similarly as described previously with respect to FIG. 2A.

The cutting head is provided with a plurality of radially extending cutting ports 103 which extend from the longitudinal bore of the tool to the exterior thereof. A piston plug 104 is located in the central bore at a position immediately to the rear of the cutting ports 103. The piston plug is provided with suitable sealing means such as o-rings 105. The threaded connections between adapter 43 and subs 97, 98, and 100 are also provided with o-rings as shown.

In operation in the embodiment shown in FIG. 6, the tool is fired similarly as described above with reference to the modifications shown in FIGS. 2A and 5. In this case, as the gaseous cutting agent is expelled toward the front of the tool, the pressure developed within the tool drives the piston 104 forward to a position below cutting ports 103. At the same time the slip array anchors the cutting tool within the tubing and the gaseous cutting agent is forced outwardly through ports 103 against the interior of the tubing. In a short period of time, normally less than second, the tubing is severed and the anchoring means is retracted, thus allowing the tool to be withdrawn from the wellbore.

The gaseous chemical cutting agent employed in the present invention contains nitrogen fluoride and desirably contains both nitrogen fluoride and molecular fluorine. Preferably, the nitrogen fluoride and molecular fluorine are employed in a mixture in which the nitrogen fluoride is present in an amount at least 25 volume percent. The preferred volume ratio of nitrogen fluoride to molecular fluorine is within the range of 1:3–3:1. A preferred cutting agent comprises approximately equal parts nitrogen flouride and flourine.

The gaseous chemical cutting agent may contain nitrogen fluoride in the form of nitrogen trifluoride ($NF_3$) tetrafluorohydrazine ($N_2F_4$) and difluorodizine ($N_2F_2$) compounds. Nitrogen trifluoride disassociates at elevated temperatures of about 1100° K.–1500° K. into the free radical $NF_2$ and fluorine. It also pyrolyzes with many of the elements to produce tetrafluorohydrazine and the corresponding fluoride. Tetrafluorohydrazine also disassociates at elevated temperatures in a reversible reaction to form the free radical $NF_2$. In practice, it is preferred that the cutting agent contain nitrogen trifluoride since it is a thermodynamically stable gas at the temperatures usually encountered and is available in commercial quantities.

Preferably the nitrogen fluoride is employed in admixture with molecular fluorine in volume ratios within the range specified above. The use of nitrogen fluoride alone or in admixture with molecular fluorine is advantgeous over the use of molecular fluorine alone in that nitrogen fluoride and the nitrogen fluoride-fluorine mixture may be confined in the chemical cutting tool at elevated pressures. Normally the confined cutting gas in the tool will be maintained at pressures in excess of 200 psi. Usually, it will be preferred to maintain the confined cutting gas at a pressure of 400 psi or more. This may be contrasted with the use of pure molecular fluorine which when stored at a pressure of about 400 psi or above becomes extremely reactive with the result that it tends to attack the container within which it is stored.

As noted previously, the cutting agent source may comprise a solid perflouroammonium salt which decomposes upon heating to produce a gaseous chemical cutting agent containing nitrogen fluoride. Suitable perfluoroammonium salts may be employed in this regard include $NF_4SbF_6$, $NF_4AsF_6$, $NF_4Sb_2F_{11}$, $NF_4Sb_3F_{16}$, $(NF_4)_2$ $TiF_6$, $(NF_4)SnF_6$, $NF_4SnF_5$, $NF_4BiF_6$, $NF_4BF_4$, $NF_4PF_6$, $NF_4GeF_5$.

These salts, when heated to temperatures on the order of about 300° C. and above decompose to form $NF_3$ and $F_2$. Since they are relatively stable at ambient temperature conditions they are relatively non-hazardous sources of nitron fluoride-fluorine mixtures. For a further description of nitrogen fluorides and perfluoroammonium salts useful in the present invention, reference is made to; KIRK-OTHMER ENCYCLOPEDIA OF CHEMICAL TECHNOLOGY Third Edition Volume 10, 1980, Pages 768–772 the disclosure of which is incorporated herein by reference.

There are various metal-metal oxide mixtures which will produce temperatures well in excess of that required for rapid decomposition of the perofluoroammonium salt to produce the gaseous cutting agent. Thermite, which is a mixture of powered aluminum and ferric oxide may be used for this purpose. Another suitable system includes a mixture aluminum and cupric oxide. Metals other than aluminum, such as magnesium, niobium and titanium may be used along with metal oxides including in addition to those noted above, ferrous oxide, ferrosoferric oxide, chromium oxide. Mixtures of one or more of the aforementioned metals with one or more of the aforementioned oxides may also be employed. In addition to the metal oxide systems which produce their own oxygen supply for combustion. Other suitable heat producing materials such as black powder may be employed.

As noted previously, bromine trifluoride has heretofore usually been considered to be the most effective cutting agent for use in downhole cutting tools of the type involved here. In experimental work carried out in respect of the invention, comparative cutting tests were run employing bromine trifluoride and a mixture of equal parts nitrogen trifluoride and molecular fluorine. The experimental work was carried out employing a discharge head of the type shown in FIG. 3. This had a nozzle with a constricted passageway diameter of 0.3 cm which was widened to 0.6 to provide a plug-abutting shoulder corresponding to the shoulder 68 shown in FIG. 3. The standoff sleeve had inner and outer diameters of 1.0 and 1.3 cm respectively and a length from the end of the enlarged bore of 1.0 cm.

The discharge head as described above was inserted in a test bore so that the end of the standoff sleeve rested upon a steel test target. Using a conventional bromine trifluoride cutting agent the target was cut to a depth of about 2.5 cm., using a mixture of equal parts of nitrogen trifluoride and molecular fluorine under a pressure of 400 psi, the test target was cut to a depth of about 7.6 cm. Both tests were carried out with stoichiometrically equivalent amounts of fluorine.

In further experimental work carried out relative to the invention, the test described immediately above was duplicated except that the standoff distance between the discharge head and the target was provided by an eccentric pin extending downwardly from the cutting port. That is, the cutting head was similar to that shown in FIG. 3 and had the dimensions described above, except that instead of a sleeve corresponding to sleeve 29, the standoff distance was provided by a single pin extending from the end of the enlarged bore section by a distance of 1.0 cm. In this test, a mixture of $NF_3$ and $F_2$ used under the same conditions as described above, produced a cut in the target to a depth of about 5 cm.

Having described specific embodiments of the present invention, it will be understood that modifications thereof may be suggested to those skilled in the art, and it is intended to cover all such modifications as far within the scope of the appended claims.

We claim:

1. In a downhole chemical fluid jet cutting tool for cutting an object within a wellbore, the combination comprising:

(a) an elongated tool body adapted for insertion into a wellbore, (b) anchoring means in with said tool body for anchoring said tool at a downhole location in response to the application of fluid pressure and for releasing said tool body in response to the release of said fluid pressure (c) a chemical section in said tool body having a chamber therein adapted to contain a source of gaseous chemical cutting agent;

(d) a cutting section in the front of said tool body having a longitudinally extending bore in fluid communication with said chemical section whereby upon the application of pressure to said chemical section a chemical cutting agent is forced into said cutting section;

(e) a pressure generating section within said tool body within which pressure is generated to actuate said anchoring means and to displace said cutting agent into said cutting section;

(f) a downwardly extending nozzle in the front of said cutting section extending from said longitudinally extending bore to the exterior of said tool body and (g) a standoff sleeve having an outer diameter which is reduced with respect to the diameter of said tool body at the front thereof, said sleeve surrounding the outlet of said nozzle and extending downwardly therefrom to provide a standoff distance between said outlet and an object to be cut within said wellbore.

2. The combination of claim 1 further comprising a plurality of longitudinally extending ribs disposed peripherally about the outer surface of said tool body in said cutting section to provide an ablative shield for the remainder of said tool body.

3. The combination of claim 2 wherein said ribs taper outwardly toward the rear of said tool.

4. The combination of claim 1 wherein said nozzle has a small diameter rear portion and an enlarged diameter front portion defining a forward facing annular shoulder within said nozzle and further comprising a blowout plug located within said passage said plug having an enlarged portion fitting into the enlarged portion of said nozzle and resting upon said forward facing shoulder whereby said plug cannot be displaced into the interior of said tool body.

5. The combination of claim 1 further comprising a dispensing piston slideably disposed within said chemical section at the rear thereof and in fluid communication with said pressure generating section whereby upon the application of pressure to the rear of said piston, said piston is displaced forward to dispel cutting agent from said nozzle.

6. The combination of claim 1 wherein said chemical section contains a solid substance which upon heating decomposes to produce a chemical cutting agent and means within said chemical section for heating said material.

7. The combination of claim 6 wherein said solid source substance comprises a plurality of annular pellets having conforming openings which are disposed to define a central passageway within said pellets and wherein said heat generating substance is disposed within said interior passageway.

8. In a downhole chemical fluid jet cutting tool for cutting an object withn a well bore, the combination comprising:

(a) an elongated tool body adapted for insertion into a wellbore, (b) anchoring means in with said tool body for anchoring said tool at a downhole location in response to the application of fluid pressure and for releasing said tool body in response to the release of said fluid pressure, (c) a chemical section in said tool body having a chamber therein adapted to contain a source of gaseous chemical cutting agent;

(d) a cutting section in said tool body having a longitudinally extending bore in fluid communication with said chemical section whereby upon the application of pressure to said chemical section, a chemical cutting agent is forced into said cutting section, said cutting section having at least one cutting port extending from said bore to the exterior of said tool body, (e) a pressure generating section within said tool body within which pressurized fluid is produced to actuate said anchoring means and to displace said cutting agent into said cutting section, and (f) a piston slidably disposed within said chemical section and interposed between said chamber and said pressure generating section to prevent commingling between pressurized fluid in said pressure generating section and chemical cutting agent within said chemical section.

9. A combination of claim 8 further comprising pressure release means responsive to the displacement of said piston to a forward position for opening said pressure generating section to fluid communication with the exterior of said tool whereby pressure behind said piston is released.

10. The combination of claim 9 wherein said pressure release means comprises means in said piston for opening said piston to fluid flow from the to the front thereof upon said piston being displaced to said forward position.

11. The combination of claim 8 wherein said piston is a compound piston having a main body portion, having a passageway system providing for fluid communication between the back and front of said piston and a valve member disposed in said main body portion which normally closes said passageway system and which opens said passageway system upon said piston being driven to said forward position.

12. The combination of claim 8 wherein said cutting port extends downwardly from said cutting section bore to the bottom of said tool whereby said tool is adapted to cut a passageway obstruction within a wellbore.

13. The combination of claim 8 wherein said cutting port extends radially from said cutting section bore to the exterior of said tool body whereby said cutting tool is adapted to cut a tubular object within said wellbore.

14. The combination of claim 13 further comprising a plurality of longitudinally extending ribs disposed peripherally about the outer surface of said tool body in said cutting section to provide an ablative shield for the remainder of said tool body.

* * * * *